US006929514B1

(12) United States Patent
Chuang

(10) Patent No.: US 6,929,514 B1
(45) Date of Patent: Aug. 16, 2005

(54) SOCKET WITH NON-CONNECTING TERMINAL

(75) Inventor: Wen-Piao Chuang, Chung Li (TW)

(73) Assignee: Chao Da Trading Co., Ltd., Chung Li (TW)

( * ) Notice: Subject to any disclaimer, the term of this patent is extended or adjusted under 35 U.S.C. 154(b) by 0 days.

(21) Appl. No.: 10/846,531

(22) Filed: May 17, 2004

(51) Int. Cl.[7] ..... H01R 13/00
(52) U.S. Cl. ..... 439/652; 439/108
(58) Field of Search ..... 439/652, 650, 439/651, 654, 108

(56) References Cited

U.S. PATENT DOCUMENTS 3,005,179 A * 10/1961 Holt ..... 439/652
3,034,084 A * 5/1962 Schmier et al. ..... 439/105
5,004,435 A * 4/1991 Jammet ..... 439/652
5,094,630 A * 3/1992 Jammet ..... 439/652
5,383,799 A * 1/1995 Fladung ..... 439/652
5,584,729 A * 12/1996 Luu ..... 439/652

* cited by examiner

*Primary Examiner*—Hien Vu
(74) *Attorney, Agent, or Firm*—Troxell Law Office, PLLC

(57) ABSTRACT

A socket with non-connecting terminal comprises a socket body, two power terminals, a bottom cover, a support, a ground terminal and a top cover in which the power terminals and the ground prong are integrally stamped without terminal tap. The power terminals are placed in the first receptacle and the second receptacle and sealed with the support and the bottom cover. The power blades are exposed outside to be connected to the wall socket. The three slots serve as a power supply to receive other plugs. The integrally stamped ground terminal is housed in the support and sealed by the top cover; the ground prong is exposed outside for linking to the power supply. The three ground slots on the ground terminal will accept the ground prongs from other plugs. When an electrical current flows through this circuit, there is no resistance encountered and no heat generated.

3 Claims, 6 Drawing Sheets

SOCKET WITH NON-CONNECTING TERMINAL

BACKGROUND OF THE INVENTION

1. Field of the Invention

This invention relates to a socket, in particular the socket has the internal terminals integrally stamped with no connector.

2. Description of the Related Art

For the prior art of three receptacle sockets as shown in FIG. 1, the slots 1', the power blades 2' and the wires 3' are enclosed with insulation material and shown in FIGS. 2 and 3, the power terminals 4' and the ground slot 5' are rivet connected and insulated.

This receptacle socket has at least two leading terminals connected together. Once the electrical current flows through, the circuit will produce an over-resistance which provokes heat and high temperature. It is not so safe for operation.

In the production line, riveting shall connect all the lead terminals. It is time-consuming and costly, for the low priced socket, it is not a lucrative business.

SUMMARY OF THE INVENTION

This invention provides a socket with no connector terminal, easy and cost effective for the industry to produce.

The important technology this invention applies is the integral formation in which the power terminals and the ground terminals are integrally stamped without connectors. Two sets of power terminals are placed in the first and second receptacles and sealed between the bottom cover and the support and two power blades are exposed outside for linking to the wall outlet. The three slots will receive the plug served as the power supply. The integrally stamped ground terminal is placed between the support and the top cover and the ground prong is exposed outside of the socket body. The ground terminal has three slots to the ground prongs form other plug. When the electrical current flows along, the non-connector terminals will never offer over-resistance. It is absolutely safe for operation. This is the key object of this invention.

DETAILED DESCRIPTION OF THE INVENTION

Figure 1:
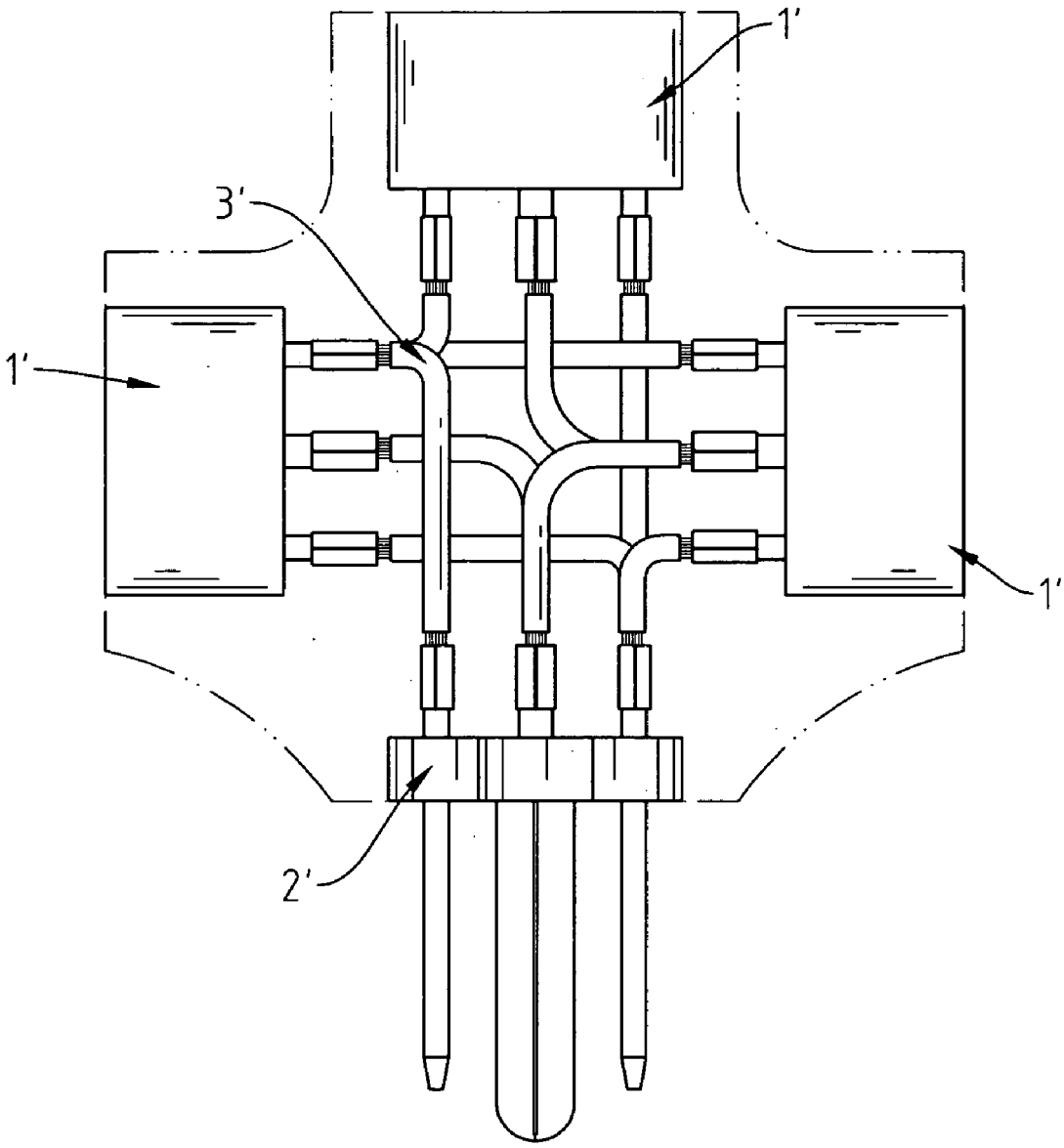
Fig. 1 Prior Art
FIG. 1 shows the circuit of the prior art of three receptacle sockets.
Figure 2:
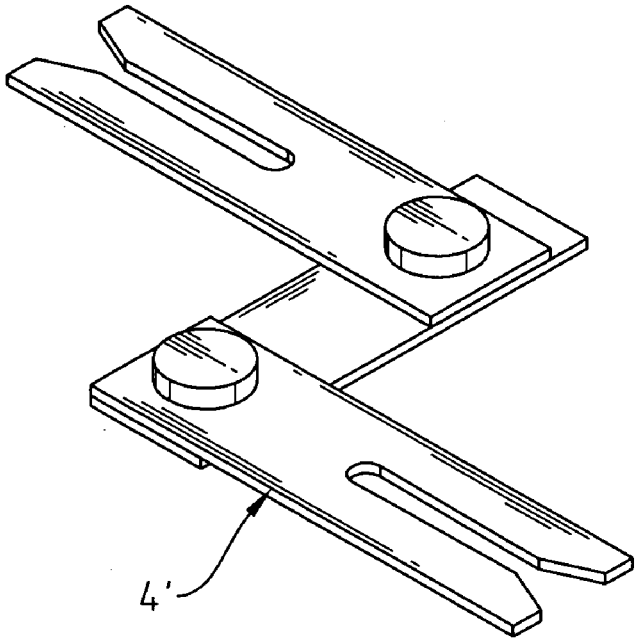
Fig. 2 Prior Art
FIG. 2 shows the rivet connection of the internal terminals of the prior art of three receptacle sockets.
Figure 3:
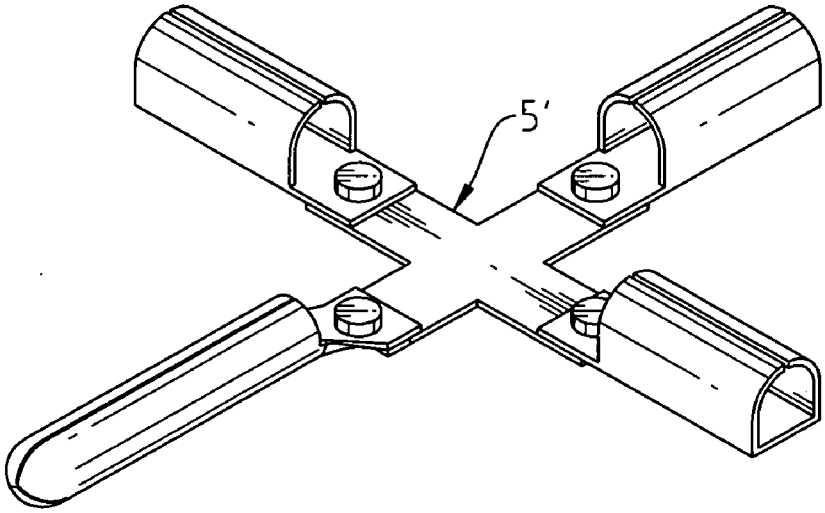
Fig. 3 Prior Art
FIG. 3 shows the rivet connection of the ground terminal of the prior art of three receptacle sockets.
Figure 4:
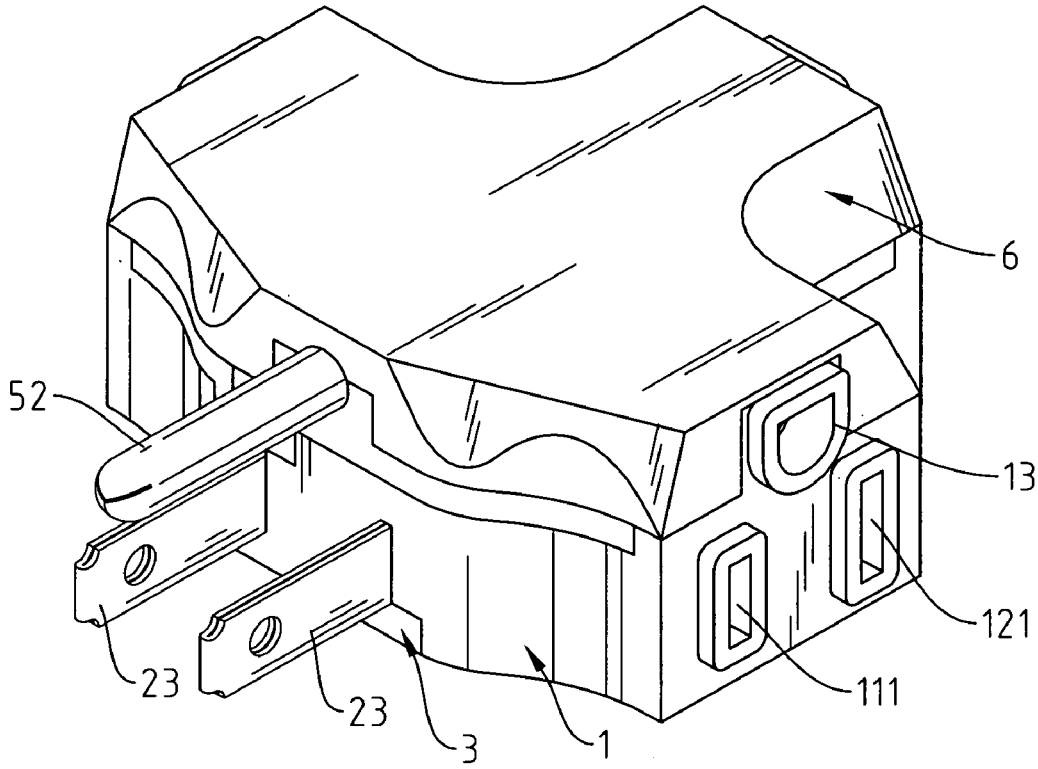
FIG. 4 shows the appearance of the socket of this invention.
Figure 5:
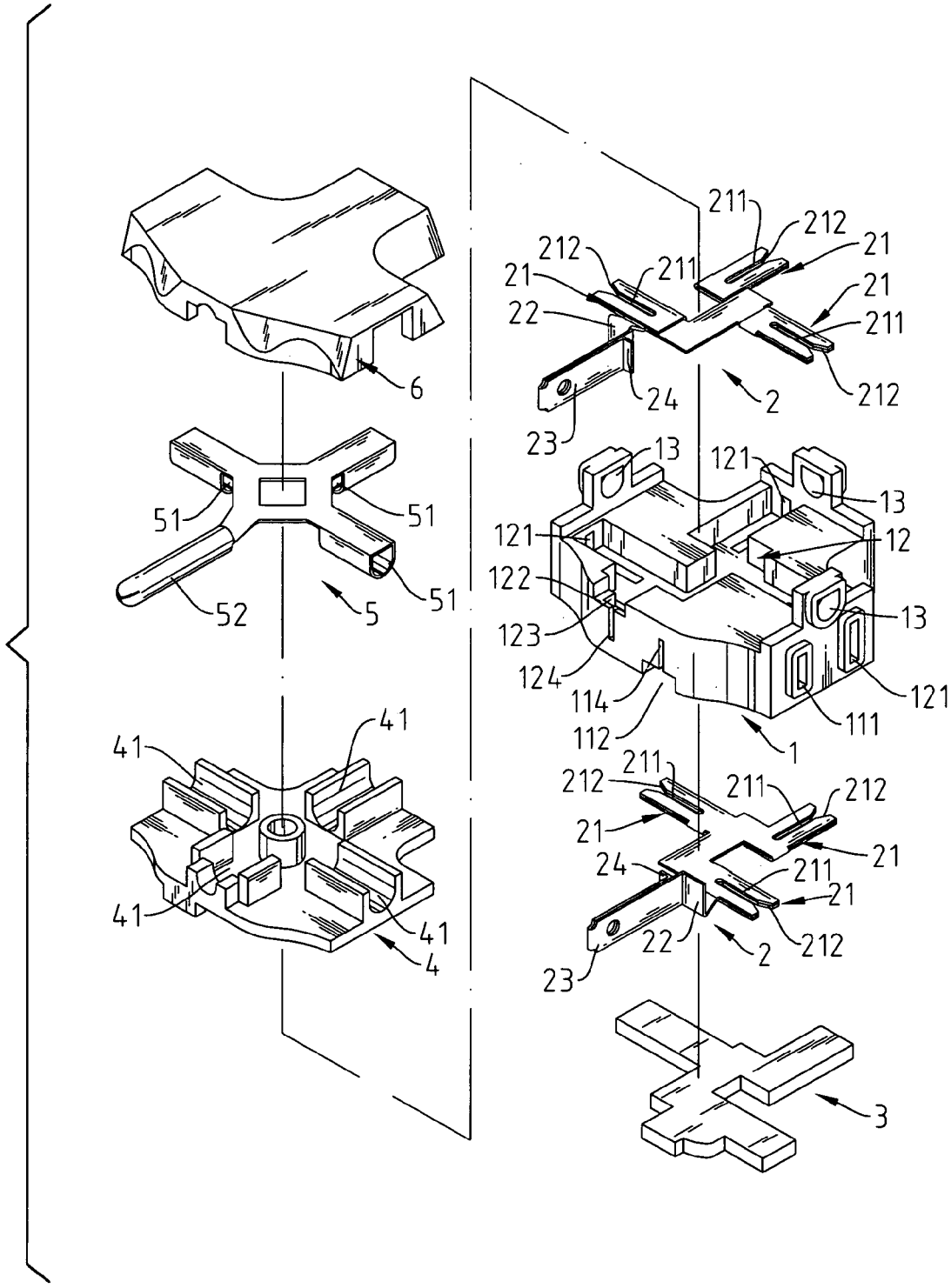
FIG. 5 shows the disassembly of the socket of this invention.

Please refer to FIGS. 4 and 5, the socket without a connector terminal mainly consists of a socket body (1), two power terminals (2), a bottom cover (3), a support (4), a ground terminal (5) and a top cover (6).

Figure 6:
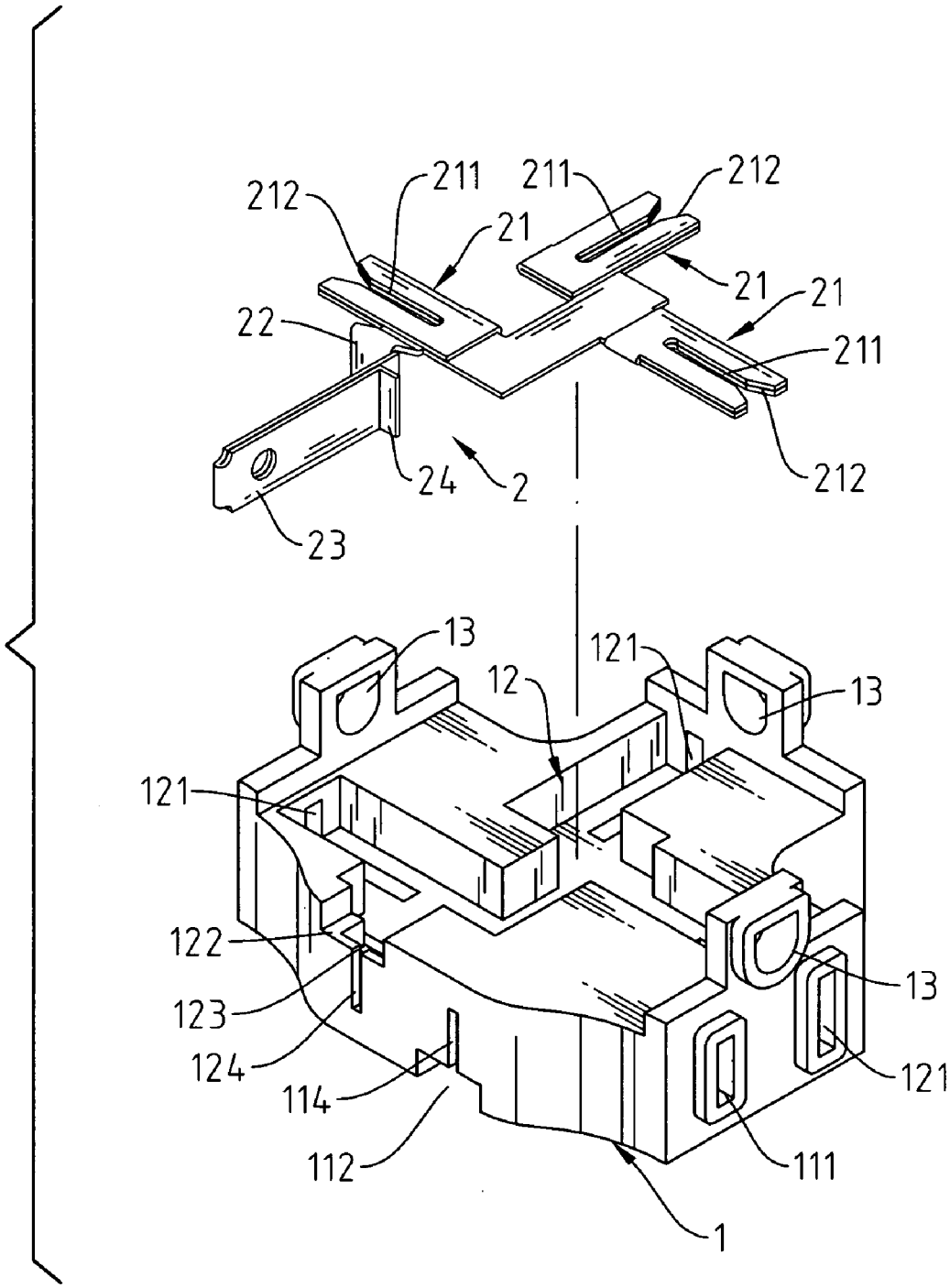
FIG. 6 shows the bottom part of the socket body of this invention.

The socket body (1) has the first receptacle (11) which has the slot (111), the side flute or side notch (112), a cut off nick or a recess (113) and a narrow open (114) (see FIG. 6). The second receptacle (12), similar to the first receptacle (11) in structure, has the slot (121), side flute or side notch (122), a cut off nick or a recess (123) and the narrow open (124). The socket body (1) has a ground slot (13) above the power slots (111) and (121).

The power terminal (2) is an integrally stamped, placed in the first receptacle (11) and the second receptacle (12) to be the non-connector terminals. The slots (111, 121) have a flap-back slot plate (21) with a central clamp groove (211) to receive the power blades of other plug, the front end of the clamp groove (211) has a slant surface easy for the insertion of other plug.

Figure 7:
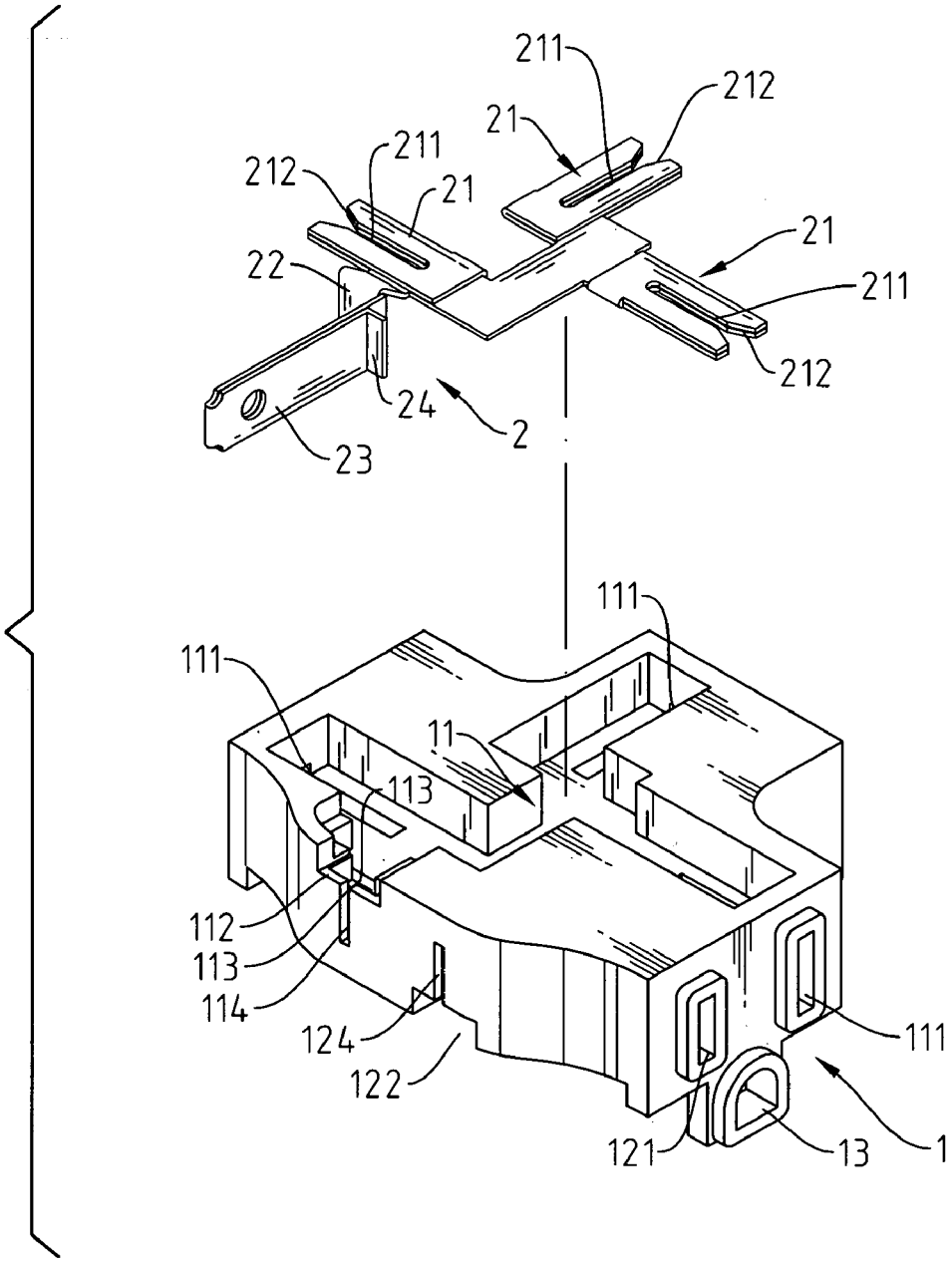
FIG. 7 shows the top part of the socket body of this invention.

As shown in FIGS. 6 and 7, the slot (121) and (122) of the first receptacle (11) and the second receptacle (12) have a downward extension (22), a flap back blade or power blade (23) and a rightward stop (24). Two sets of the power terminals (2) are placed in the first receptacle (11) and the second receptacle (12), the slot plates (21) are housed along the passage of the first receptacle (11) and the second receptacle (12), the down extensions (22) are inserted into the cut off nicks (113) (123) and the power blades (23) are interest in the narrow opens (114) (124) of the first receptacle (11) and the second receptacle (12). Since the stops (24) of the power blades (23) are fixed in the cut off nick (113) (123) to keep the power terminals (2) retained firmly in the first receptacle (11) and the second receptacle (12) without lateral displacement and the power blades (23) steadfast extend outside of the socket body (1).

The bottom cover (3) is designed to seal the first receptacle (11) and the power terminal (2).

The support (4) sustains the power terminal (2) in the second receptacle (12) and the ground slot (13) in a cross arrangement to be sitting in the terminal flute or trough (41).

The ground terminal (5) is an integrally stamped sitting in the terminal flute (41) of the support (4) with a round prong (52) extended out of the socket body (1). The ground terminal (5) is integrally formed to form a connector terminal. There is a round ground conduit (51) at each end linked with the ground slot (13). A ground prong (52) extended out of the socket body (1).

The top cover (6) covers the socket body (1) and the ground terminal (5).

View from the statement, it is learn that the non connector power terminal (2) is placed in the first receptacle (11) and the second receptacle (12) and sealed with the bottom cover (3) and the support (4). The power blades (23) are extended out of the socket body (1) for linking to the power supply. The slot plate (21) of the slot (111), (121) forms a linkage of power. The ground terminal (5) sits in the terminal flute (41) of the support (4), sealed with top cover (6) and the ground prong (52) exposes to the outside of the socket body (1). The ground slot (13) has the ground conduit (51) to receive the ground prong (52) of other plug. So these two power terminals (2) and one ground terminal (5) are all integrally stamped with no connection among them. When there is current flowing, there is no resistance and heat generated along the circuit. It is safe for operation, worth mass production.

What the invention claimed is:

1. A socket comprising:

a) a socket body having:

i) a first receptacle located on a bottom thereof; and ii) a second receptacle located on a top thereof;

b) two power terminals, each of the two power terminals having:

i) a plurality of slot plates, each of the plurality of slot plates having a central clamp groove; and ii) a power blade, a first of the two power terminals is inserted into the first receptacle on the bottom of the socket body and a second of the two power terminals is inserted into the second receptacle on the top of the socket body, each power blade extending outwardly from the socket body;

c) a bottom cover located on the bottom of the socket body and covering the first receptacle;

d) a support located on a top of the second receptacle and having a plurality of troughs;

e) a ground terminal having a plurality of grounding conduits and a round prong, one of the plurality of grounding conduits and the round prong is inserted into each of the plurality of troughs, the round prong extending outwardly from the socket body above the two power terminals; and f) a top cover located on the top of the socket body and covering the support;

wherein each of the first and the second receptacles has a slot, a side notch, a recess, and a narrow opening.

2. The socket according to claim 1, wherein each of the plurality of slot plates has a slant surface.

3. The socket according to claim 1, wherein the power blade of each of the two power terminals has a stop extending outwardly, each stop positioning one of the two power terminals in the socket body.

* * * * *